US009526294B2

(12) United States Patent
Larsen

(10) Patent No.: US 9,526,294 B2
(45) **Date of Patent: *Dec. 27, 2016**

(54) FOOTWEAR WITH INSERTABLE LIGHTING ASSEMBLY

(71) Applicant: Troy Larsen, Thornton, CO (US)

(72) Inventor: Troy Larsen, Thornton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/524,187

(22) Filed: Oct. 27, 2014

(65) Prior Publication Data

US 2016/0198788 A1 Jul. 14, 2016

(51) Int. Cl.
*F21V 33/00* (2006.01)
*A43B 3/00* (2006.01)

(52) U.S. Cl.
CPC ..... *A43B 3/001* (2013.01); *F21V 33/0008* (2013.01)

(58) Field of Classification Search
CPC . F21V 33/0008; F21V 2200/40; A43B 3/0001
USPC ..... 362/103
See application file for complete search history.

(56) References Cited

U.S. PATENT DOCUMENTS 3,008,038 A 11/1961 Dickens et al.
3,946,505 A 3/1976 Dana, III
4,848,009 A 7/1989 Rodgers
5,303,485 A 4/1994 Goldston et al.
5,490,338 A * 2/1996 Hwang ..... A43B 3/001 36/136
5,500,635 A 3/1996 Mott
5,599,088 A * 2/1997 Chien ..... A43B 1/0072 200/61.45 R
5,692,324 A * 12/1997 Goldston ..... A43B 1/0036 36/136
5,704,706 A * 1/1998 Goldston ..... A43B 1/0072 362/103
5,746,499 A * 5/1998 Ratcliffe ..... A43B 3/001 36/137
5,758,946 A 6/1998 Chen
6,017,128 A * 1/2000 Goldston ..... A43B 1/0036 36/137
6,050,007 A * 4/2000 Angelieri ..... A43B 1/0036 36/137
7,866,066 B2 1/2011 Forbes
8,281,440 B2 10/2012 Cheung
8,356,430 B2 * 1/2013 Beers ..... A43B 13/20 36/137
2004/0130887 A1 7/2004 Wei et al.
(Continued)

FOREIGN PATENT DOCUMENTS

CN 202618472 U 12/2012
CN 203168147 U 9/2013

*Primary Examiner* — Julie Bannan
(74) *Attorney, Agent, or Firm* — Wessels & Arsenault, LLC; John Allan Arsenault; Daniel Dubuisson

(57) ABSTRACT

The present invention relates to footwear having a sole structure with a cushion layer wherein a lighting assembly, having a switch, a power source, and at least one light source or LED, can be inserted and attached into the sole structure to provide external illumination from the footwear. The cushion layer exhibits a means for transmitting light from the lighting assembly secured within to the exterior of the footwear, the means for transmitting light can take the form of a polymeric material of at least partial transparency, in some cases having a fluid enclosed within or the form of a plurality of light transmission channels.

19 Claims, 9 Drawing Sheets

(56) References Cited

U.S. PATENT DOCUMENTS

| | | | | |
|---|---|---|---|---|
| 2006/0198121 | A1 | 9/2006 | Thorpe et al. | |
| 2011/0119963 | A1 | 5/2011 | Braynock et al. | |
| 2014/0173942 | A1 | 6/2014 | Gou | |
| 2014/0355255 | A1* | 12/2014 | Hsu | A43B 3/001 362/103 |

* cited by examiner

FOOTWEAR WITH INSERTABLE LIGHTING ASSEMBLY

STATEMENT REGARDING FEDERALLY SPONSORED RESEARCH AND DEVELOPMENT

Not Applicable

CROSS-REFERENCE TO RELATED APPLICATION

Not Applicable

BACKGROUND OF DISCLOSURE

1. Field of Invention

The present invention relates to footwear, and more particularly to footwear having a sole structure wherein an insertable lighting assembly provides visible illumination around the footwear exterior, thus enhancing safety and appearance.

2. Description of Prior Art

Illuminating footwear is popular amongst children and adults for amusement and safety. Numerous shoe types have been developed to provide illumination; however, these methods suffer from a number of disadvantages.

U.S. Pat. No. 4,848,009 to Rodgers discloses footwear with light sources visible on the footwear exterior and power to the light sources controlled by a means responsive to the motion of the footwear.

U.S. Pat. No. 8,281,440 to Cheung discloses footwear with at least one light source located in the upper part and a method for manufacturing the same, which requires thermal energy to vulcanize the assembled unit to secure the upper to a bonding strip and a shoe bottom.

The prior art describes footwear comprising electronic components within the interior. Unfortunately, after some time passes, electronic components such as batteries and/or light elements must eventually be replaced. This becomes troublesome for the footwear described in the prior art and often requires replacement of the footwear in entirety. The present invention overcomes these disadvantages by providing illuminating footwear with electronic components that are reduced in number and that can be replaced in a simple and cost effective manner. Additionally, the present invention can be adapted to fasten to pre-existing footwear and include several interchangeable options depending on the color and lighting preferences of the wearer.

SUMMARY OF THE DISCLOSURE

A primary embodiment of the present invention is to provide footwear with a sole structure having a cushion layer wherein a lighting strip can be inserted through the cushion layer and reversibly secured to generate illumination that traverses to the footwear exterior by a means for transmitting light that attaches or secures to the bottom sole of a shoe. The entirety of the electronic components are contained within the lighting assembly, allowing for more cost effective replacement.

In one embodiment, the means for transmitting light is the cushion layer being manufactured using a polymer material of at least partial transparency.

In one embodiment, the means for transmitting light is the cushion layer being manufactured using a polymer of at least partial transparency and having internal enclosure containing a fluid.

In one embodiment, the means for transmitting light is the cushion layer being manufactured to have a plurality of light transmission channels.

In one embodiment, the cushion layer includes a heel portion and a front sole portion.

In one embodiment, the sole structure is manufactured to be attachable to the bottom sole of pre-existing footwear.

Figure 1A:
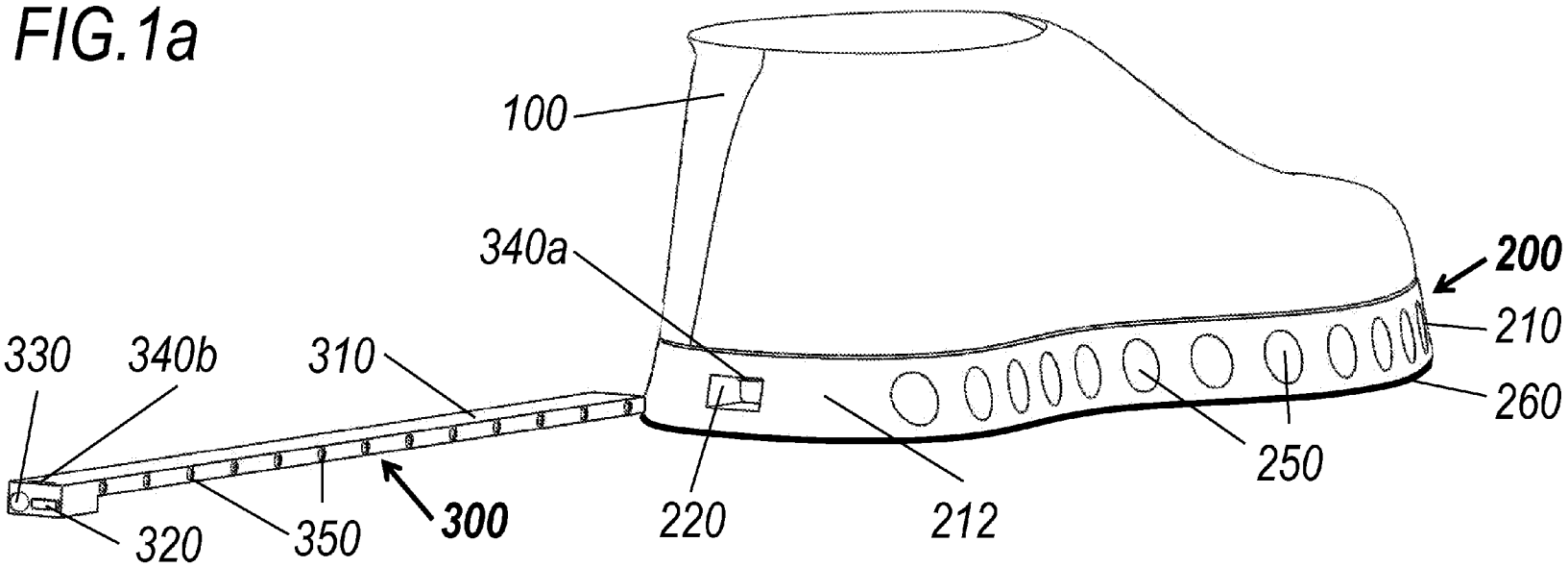
FIG. 1*a* is a perspective views of footwear with an insertable lighting assembly detached from the footwear, in accordance with an exemplary embodiment of the present invention.

The above described figures depict various embodiments of the present invention for purposes of illustration only. One skilled in the art will readily recognize that alternative embodiments that fall within the scope of the invention described herein are possible.

REFERENCE NUMERALS IN THE DRAWINGS shoe upper 100
sole structure 200
cushion layer 210
cushion perimeter 212
heel portion 214
front sole portion 216
receiving channel 220
electronic circuit 240
light transmission channel 250
outer sole 260
enclosed fluid 270
lighting assembly 300
lighting strip 310
power source 320
switch 330
shoe clip portion 340*a*
assembly clip portion 340*b*
light source 350

DETAILED DESCRIPTION OF THE DISCLOSED EMBODIMENTS

The following description is provided to enable any person skilled in the art to make and use the disclosed embodiments. Various modifications, however, will remain readily apparent to those skilled in the art, since the generic principles of the embodiments have been defined herein specifically to provide for footwear wherein a reversibly attachable lighting assembly can be inserted to provide external illumination.

Illustrative embodiments of the invention are described below in the accompanying Figures. The following detailed description provides detailed schematics for a thorough understanding of and an enabling description for these embodiments. One having ordinary skill in the art will understand that the invention may be practiced without certain details. In other instances, well-known structures and functions have not been shown or described in detail to avoid unnecessarily obscuring the description of the embodiments.

Also, it is noted that as used herein and in the appended claims, the singular forms, "a," "and," "said," and "the" include plural references unless the context clearly states to the contrary. Conversely, it is also contemplated that the claims disclosed herein may be drafted as to require singular elements or exclude any optional element indicated to be so here in the accompanying text or drawings. This statement is to serve as an antecedent basis for the use of exclusive terminology as "solely," "only" and similar terms in connection with the recitation of claims elements or the use of a "negative" claim limitation(s).

Figure 1B:
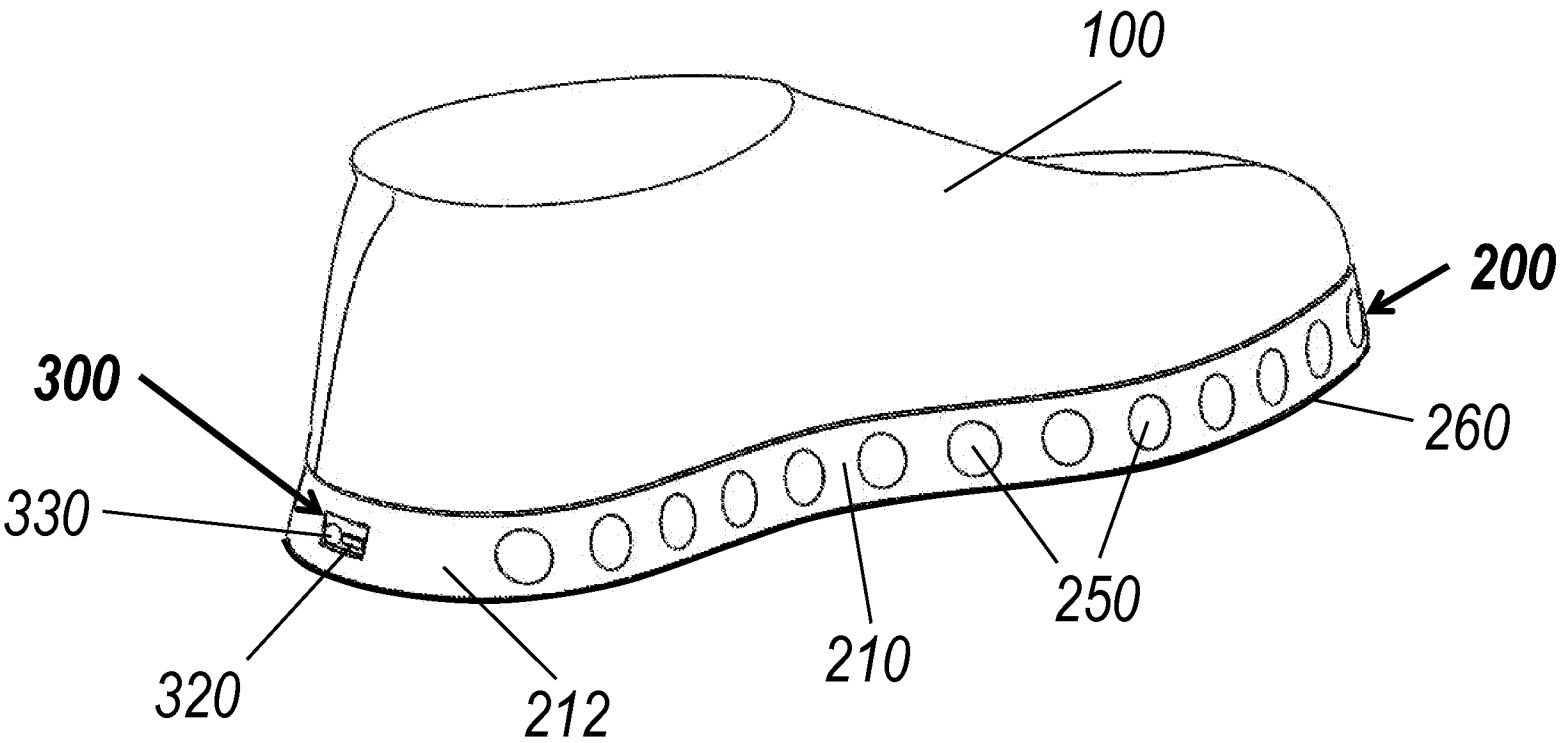
FIG. 1*b* is a perspective views of footwear with an insertable lighting assembly inserted into the footwear, in accordance with an exemplary embodiment of the present invention.

FIG. 1*a* is a perspective views of footwear with an insertable lighting assembly detached from the footwear, in accordance with an exemplary embodiment of the present invention. FIG. 1*b* is a perspective views of footwear with an insertable lighting assembly inserted into the footwear through the sole, in accordance with an exemplary embodiment of the present invention. The footwear has a shoe upper 100 fastened to a sole structure 200 comprising a cushion layer 210 wherein a receiving channel 220 extends from the quarter, or rear portion, at least partially therethrough the interior and is fabricated to receive lighting assembly 300, which may be secured into and released from place, generally via shoe clip portion 340*a*, located on the quarter of cushion layer 210, and assembly clip portion 340*b*, located on rear portion of lighting assembly 300. In the examples shown in FIG. 1*a* and FIG. 1*b*, shoe clip portion 340*a* and assembly clip portion 340*b* fasten the lighting assembly 300 to the receiving channel 220. There are several other suitable alternatives to fasten the lighting assembly 300 into receiving channel 220 so that detachment occurs only when the user desires. For example, friction between the outer surfaces of the lighting assembly 300 and inner surfaces of the receiving channel 220 can also be used to secure lighting assembly 300 within the footwear. Other devices suitable for fastening the lighting assembly 300 into receiving channel 220 include, but are not limited to, a clasp, a hasp, a clamp, a pin, a catch, a fastener, a buckle, or a combination thereof. Additionally, it is contemplated that insertion of lighting assembly 300 into receiving channel 220 may be enhanced with a guide rail that extends along receiving channel 220 and guides lighting assembly 300 therein.

Power to the lighting assembly 300 is supplied by at least one power source 320 and may be toggled on and off by the user via switch 330. Numerous power sources 320 are suitable for the disclosed embodiment. Examples of power sources 320 include, but are not limited to, a battery, a solar cell, or a piezoelectric source. The footwear, whilst in the configuration shown in FIG. 1*b* with the lighting assembly 300 secured into receiving channel 220 and switch 330 set to on position, provides illumination through the cushion perimeter 212 and away from the shoe. By way of example, the lighting assembly 300 shown FIG. 1*a* and FIG. 1*b* has similar dimensions to the receiving channel 220, which may provide a secure fit; however, it is understood that a receiving channel 220 with larger dimensions than lighting assembly 300 would also be suitable. The cushion layer 210 is formed to incorporate a means for transmitting light, which enables light to traverse from the receiving channel 220 to outside the cushion perimeter 212. In the example shown in FIG. 1*a* and FIG. 1*b*, the means for transmitting light comprises a plurality of light transmission channels 250 that guide light generated from the lighting assembly 300 to outside the cushion perimeter 212. FIG. 1*a* and FIG. 1*b* illustrate the reversible insertion and securing of lighting assembly 300 into the interior of cushion layer 210. In some cases, it may be desirable for the sole structure 200 to further comprise an outer sole 260 manufactured from a wear-resistant, durable material, such as rubber or derivatives thereof, to extending the lifetime of the footwear. Additionally, it is contemplated that the sole structure 200 alone may be acquired separately and fastened to pre-existing footwear.

Figure 2:
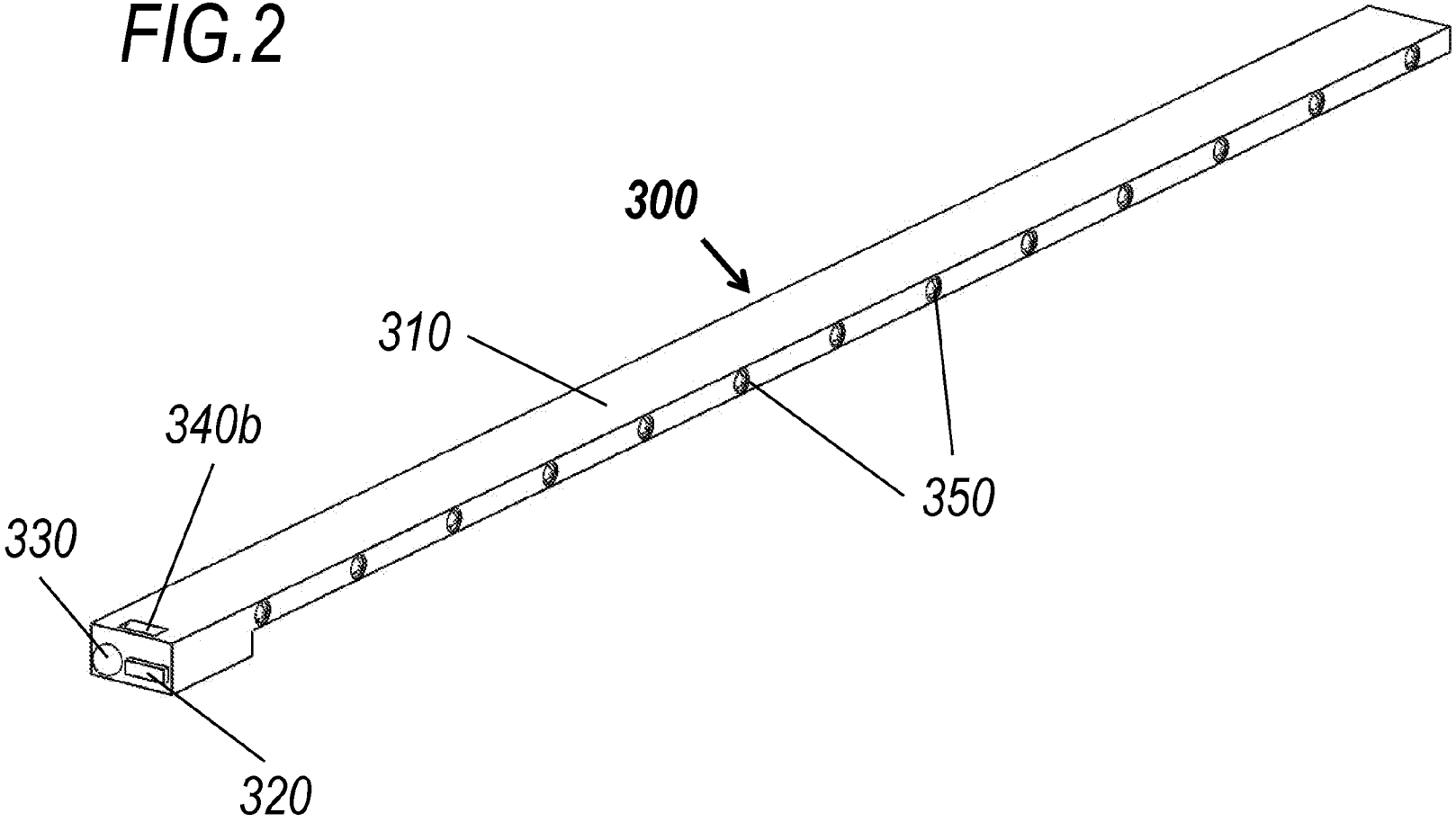
FIG. 2 is a perspective view of a lighting assembly, in accordance with an exemplary embodiment of the present invention.

FIG. 2 is a perspective view of only the lighting assembly, in accordance with an exemplary embodiment of the present invention. The lighting assembly 300 comprises a power source 320, a switch 330, a lighting strip 310 having at least one light source 350, and an assembly clip portion 340*b*. The switch 330 is accessible from the portion of lighting assembly 300 opposite to the lighting strip 310. Whilst it may be advantageous to use a waterproof hemispherical pushbutton switch to toggle power on and off, it is contemplated that other simple devices could also be used. Examples include, but are not limited to, toggle switches, selector switches, or any pushbutton switches. Lighting assembly 300 is fabricated with power source 320 adjacent to the rear portion of lighting assembly 300 and adjacent to switch 330 so that it can be conveniently accessed and replaced. The example lighting assembly 300 shown in FIG. 2 shows the power source 320 to be accessible from the rear portion of the lighting assembly 300; however, it is contemplated that configurations with the power source 320 being accessible from other surfaces near the rear portion of lighting assembly 300 may be advantageous in some cases.

The lighting strip 310, which may be rigid or flexible, houses at least one light source 350 which may be positioned at any location on the lighting strip 310 and oriented to emit light outward in any direction. Whilst in many cases it is advantageous in terms of manufacturability and power consumption for light source 350 to be a LED (light emitting diode), it is contemplated that other types of sources would suffice. Additionally, a single light source 350 capable of emitting light along the entire length of lighting strip 310 would also be suitable.

Figure 3:
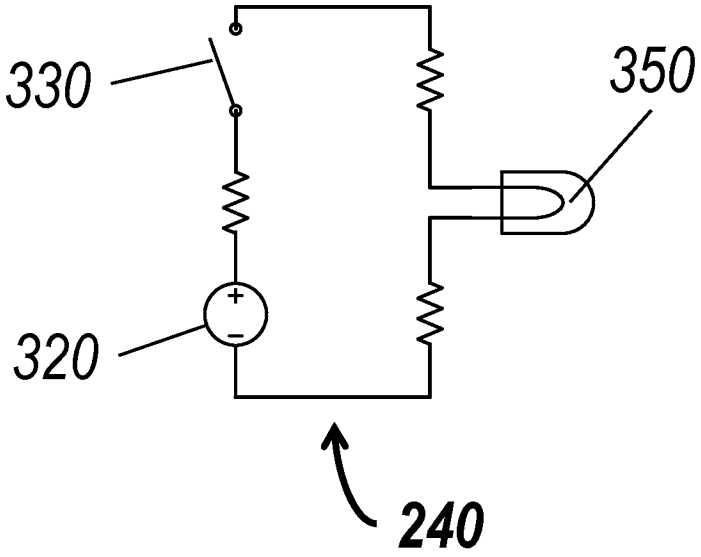
FIG. 3 is a schematic diagram of an electronic circuit that may be used in accordance with the various exemplary embodiments of the present invention.

FIG. 3 is a schematic diagram of an electronic circuit that may be used in accordance with the various exemplary embodiments of the present invention. The electronic circuit 240 comprises a power source 320, a switch 330, and at least one light source 350. It is contemplated that an electronic circuit 240 capable of carrying electrical signal to the lighting strip 310 in a controlled manner for purposes of adjusting the interval and duration of illuminating each light source 350 would also fall within the scope of this disclosure. The interchangeability and cost of lighting assembly 300 allows the user to replace less desirable or broken lighting assemblies in a simple and cost effective manner and without having to replace the entire footwear set.

Figure 4:
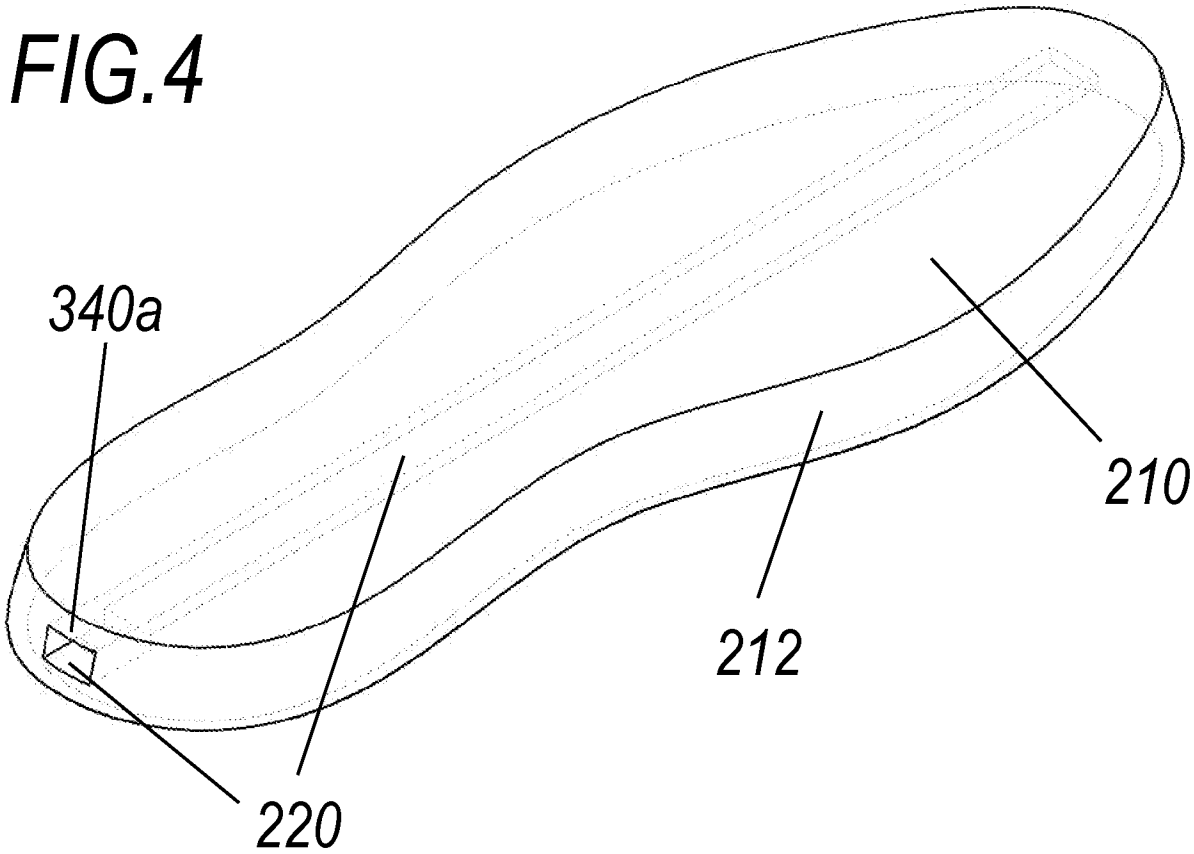
FIG. 4 is a perspective view of only the cushion layer comprising a medium of at least partial transparency, in accordance with an exemplary embodiment of the present invention.

FIG. 4 is a perspective view of a cushion layer comprising a medium of at least partial transparency, in accordance with an exemplary embodiment of the present invention. The cushion layer 210 includes a receiving channel 220 extending from the rear side of the cushion layer 210 partially through the interior, a cushion perimeter 212 surrounding the cushion layer 210, and shoe clip portion 340*a*. In this example embodiment, the means for transmitting light comprises a light conducting material exhibiting at least partial transparency wherein light can traverse from the lighting strip 150 on lighting assembly 300 to outside the cushion perimeter 212. Suitable materials for a cushion layer 210 providing this means for transmitting light include, but are not limited to, natural rubber, polyurethane, polyvinyl chloride, polyamide, or combinations thereof.

Figure 5:
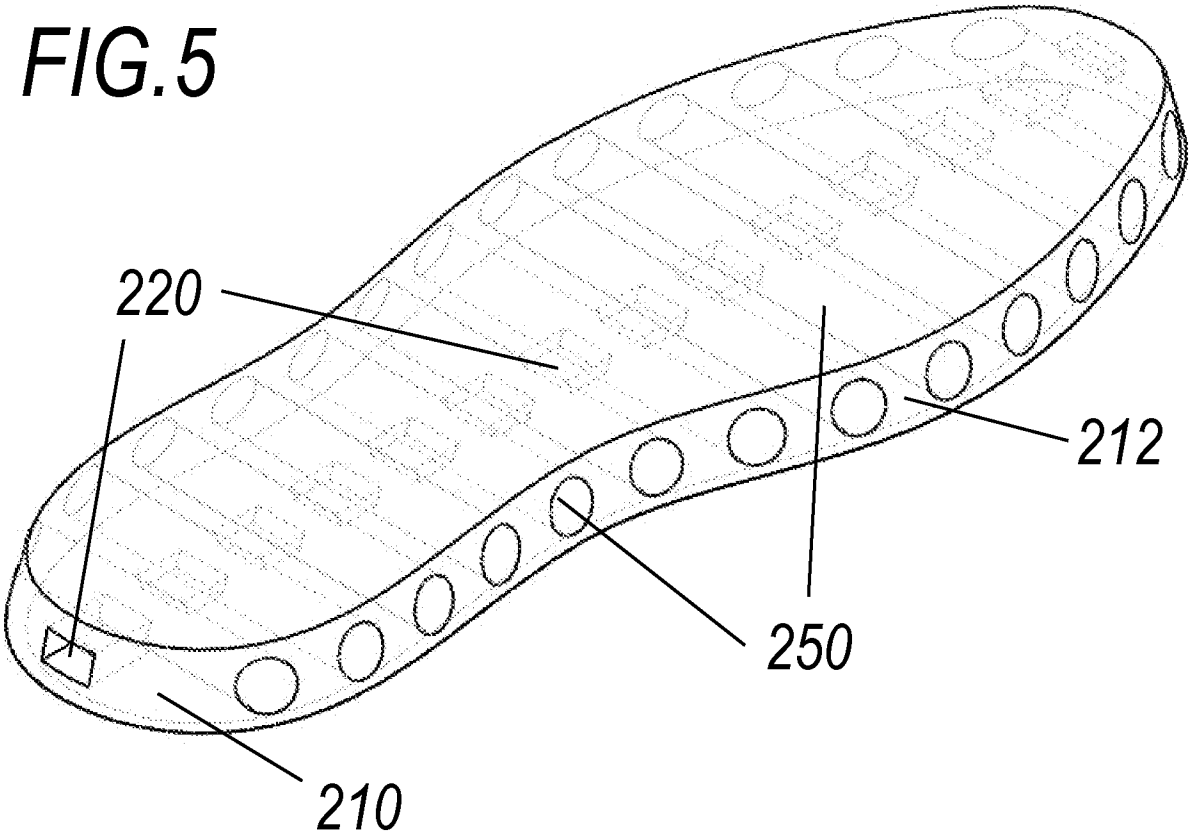
FIG. 5 is a perspective view of a cushion layer including a plurality of light transmission channels, in accordance with an exemplary embodiment of the present invention.

FIG. 5 is a perspective view of a cushion layer including a plurality of light transmission channels, in accordance with an exemplary embodiment of the present invention. Similar to the cushion layer 210 shown in FIG. 1*a* and FIG. 1*b*, the means for transmitting light comprises a plurality of light transmission channels 250 that guide light from the light strip 310 to outside the cushion perimeter 212. The light transmission channels 250 in this example take the form of hollowed cylinders that are oriented perpendicular to the receiving channel 220, or to the axis of the sole; however it is contemplated that other types and orientations of light transmission channels 250 would be suitable. Examples include, but are not limited to, channels exhibiting cross sectional areas shapes as an alternative to circular forms, such as elliptical, rectangular and other polygons, and irregular forms, channels oriented perpendicular to point of the cushion perimeter 212 and other channels not oriented perpendicular to the receiving channel 220, channels exhibiting tortuous pathways between the receiving channel 220 and cushion perimeter 212. Additionally, a plurality of or a combination of any above mentioned examples of light transmission channels 250 would also fall within the scope of the present invention.

The light transmission channels 250 are contemplated to exhibit at least partial transparency; however it is not necessary for the cushion layer 210 in this example embodiment to be fabricated from a material exhibiting at least partial transparency. The light transmission channels 250 may be comprised of air or other gases, solid materials exhibiting partial transparency, or a combination thereof.

Figure 6:
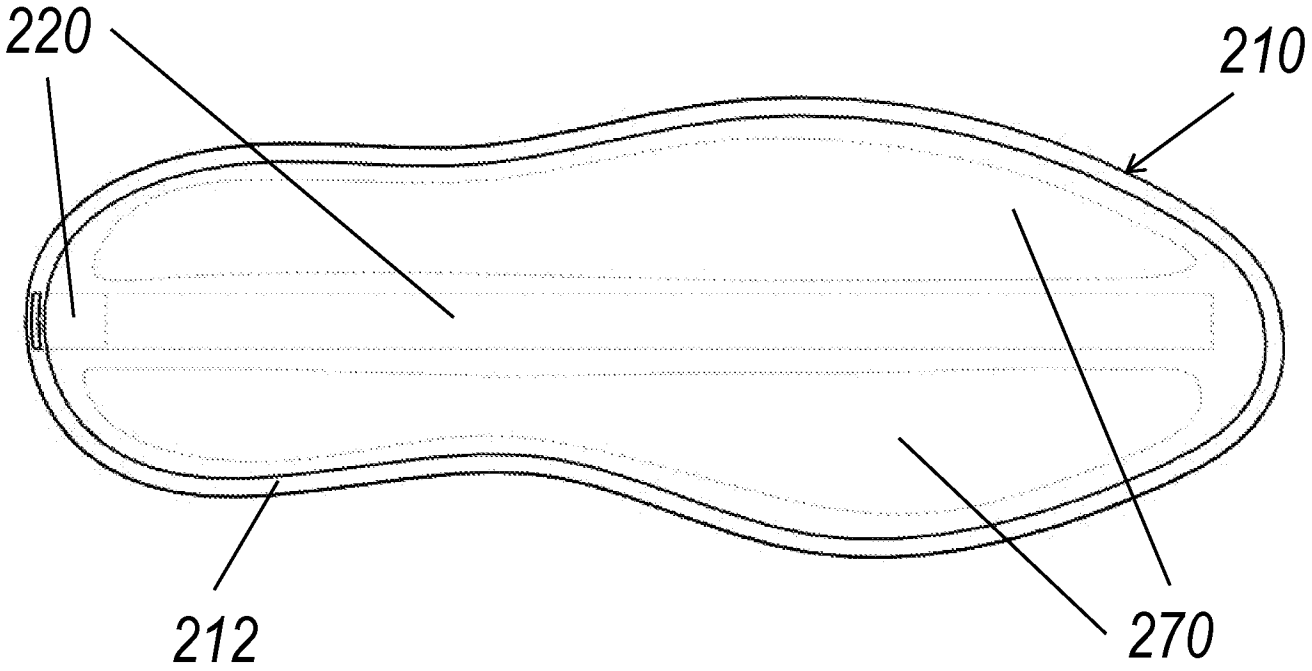
FIG. 6 is a top side view of a cushion layer with enclosed fluid, in accordance with an exemplary embodiment of the present invention.

FIG. 6 is a top side view of a cushion layer with enclosed fluid, in accordance with an exemplary embodiment of the present invention. The enclosed fluid 270 is positioned within the cushion layer 210 between the receiving channel 220 and the cushion perimeter 212 and refracts light differently than cushion layer 210, thus altering the appearance of the light transmitting through cushion layer 210, which may be desirable to some users. Additionally, the enclosed fluid 270 provides additional padding that enhances comfort for the user. The cushion layer 210 in this example embodiment will comprise a material exhibiting at least partial transparency as described previously, and the enclosed fluid 270 contained within may be a vapor, a liquid, or a combination thereof.

Figure 7A:
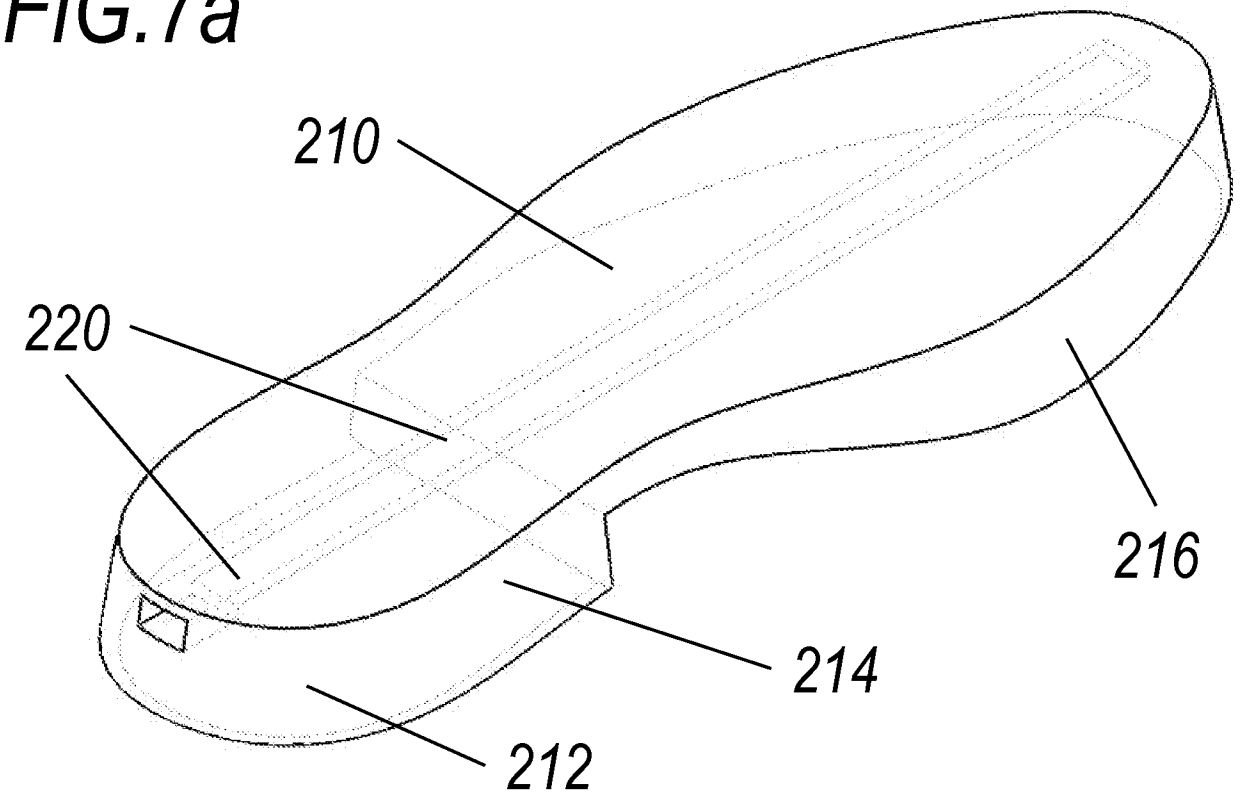
FIG. 7*a* is a perspective view of boot-style footwear wherein an insertable lighting assembly can be attached, in accordance with an exemplary embodiment of the present invention.
Figure 7B:
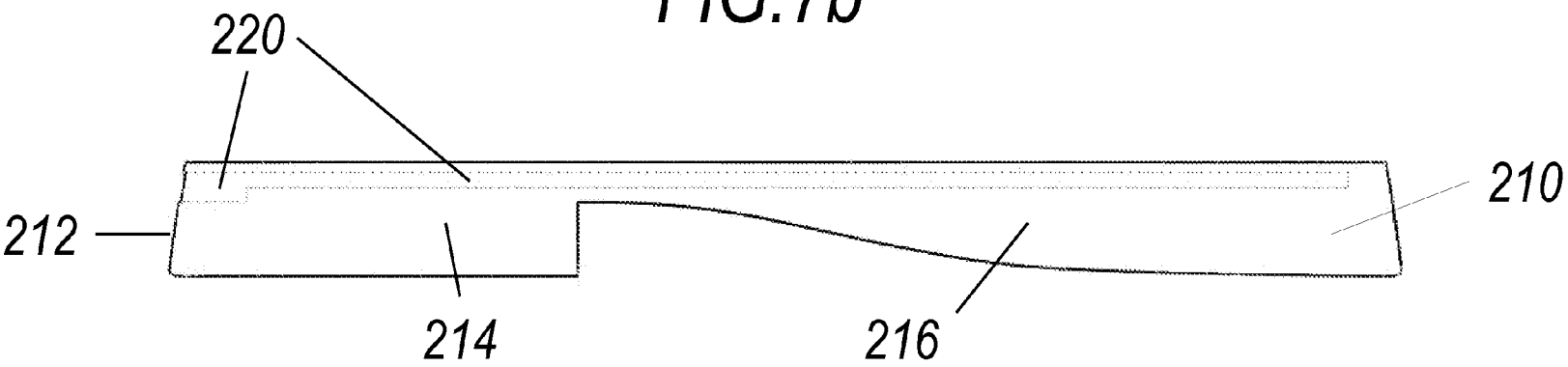
FIG. 7*b* is a side view of boot-style footwear wherein an insertable lighting assembly can be attached, in accordance with an exemplary embodiment of the present invention.

FIG. 7*a* is a perspective view of boot-style footwear wherein an insertable lighting assembly can be attached, in accordance with an exemplary embodiment of the present invention. FIG. 7*b* is a side view of boot-style footwear wherein an insertable lighting assembly can be attached, in accordance with an exemplary embodiment of the present invention. The cushion layer 210 in this embodiment comprises a heel portion 214 and a front sole portion 216, which may further enhance user appearance and comfort. The receiving channel 220 extends from the quarter, or rear portion, of the cushion layer 210 at least partially therethrough the interior.

While a particular embodiment of the invention has been described and disclosed in the present application, it is clear that any number of permutations, modifications, or embodiments may be made without departing from the spirit and the scope of this invention. Accordingly, it is not the inventor's intention to limit this invention in the present application, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise embodiment or form disclosed herein or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

In light of the above "Detailed Description," Inventor may make changes to the invention. While the detailed description outlines possible embodiments of the invention and discloses the best mode contemplated, no matter how detailed the above appears in text, the invention may be practiced in a myriad of ways. Thus, implementation details may vary considerably while still being encompassed by the spirit of the invention as disclosed by the inventor. As discussed herein, specific terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

I claim:

1. An article of footwear having a shoe upper and a sole structure secured to said shoe upper, said sole structure comprising:

a cushion layer comprising a cushion perimeter, a rear portion and a receiving channel extending therethrough the interior of said cushion layer from said rear portion;

a means for transmitting light from said receiving channel to said cushion perimeter;

a lighting assembly reversibly attachable and insertable into said receiving channel through an outer rear surface of the footwear, said lighting assembly comprising a power source, a switch exposed at said rear surface which is connected via an electronic circuit with a lighting strip and said power source, and said lighting strip comprising at least one light source, wherein said power source is positioned adjacent to said rear portion of said lighting assembly or adjacent to said switch;

wherein said cushion layer further comprises a plurality of light transmission channels extending from said receiving channel to said cushion perimeter thereby defining said means for transmitting light; and wherein said light transmission channels are hollowed cylinders oriented perpendicular to said receiving channel.

2. The article of footwear in accordance with claim 1, wherein said means for transmitting light comprises a medium exhibiting at least partial transparency.

3. The article of footwear in accordance with claim 1, wherein said power source is selected from a group consisting of a solar source, a piezoelectric source, and a battery.

4. The article of footwear in accordance with claim 1, wherein said switch is selected from a group consisting of a pushbutton switch, a toggle switch, and a selector switch.

5. The article of footwear in accordance with claim 1, wherein said lighting assembly further comprises a light control circuit.

6. The article of footwear in accordance with claim 1, wherein said cushion layer further comprises an outer sole.

7. The article of footwear in accordance with claim 1, wherein said cushion layer further comprises a heel portion and a front sole portion.

8. The article of footwear in accordance with claim 1, wherein said light source comprises a light emitting diode (LED).

9. A sole structure that securely attaches to the bottom of an article of footwear article, said sole structure comprising:

a cushion layer comprising a rear portion and a receiving channel extending therethrough the interior of said cushion layer from said rear portion;

a means for transmitting light from said receiving channel to a cushion perimeter;

a lighting assembly reversibly attachable and insertable into said receiving channel through an outer rear surface of the footwear, said lighting assembly comprising a power source, a switch exposed at said rear surface which is connected via an electronic circuit with a lighting strip and said power source, and said lighting strip comprising at least one light source, wherein said power source is positioned adjacent to said rear portion of said lighting assembly or adjacent to said switch; and wherein said cushion layer further comprises a plurality of light transmission channels extending from said receiving channel to said cushion perimeter thereby defining said means for transmitting light.

10. The sole structure in accordance with claim 9, wherein said means for transmitting light comprises a medium exhibiting at least partial transparency.

11. The sole structure in accordance with claim 10, wherein said means for transmitting light further comprises an enclosed fluid within said cushion layer.

12. The sole structure in accordance with claim 9, wherein said power source is selected from a group consisting of a solar source, a piezoelectric source, and a battery.

13. The sole structure in accordance with claim 9, wherein said switch is selected from a group consisting of a pushbutton switch, a toggle switch, and a selector switch.

14. The sole structure in accordance with claim 9, wherein said lighting assembly further comprises a light control circuit.

15. The sole structure in accordance with claim 9, wherein said cushion layer further comprises an outer sole.

16. The article of footwear in accordance with claim 9, wherein said cushion layer further comprises a heel portion and a front sole portion.

17. The article of footwear in accordance with claim 9, wherein said light source comprises a light emitting diode (LED).

18. The article of footwear in accordance with claim 1, further comprising a shoe clip portion located on said rear portion and an assembly clip portion located on said lighting assembly, wherein said shoe clip portion and said assembly clip portion secures said lighting assembly into and releases from said receiving channel.

19. The article of footwear in accordance with claim 4, wherein said push button switch is a waterproof hemispherical pushbutton switch.

* * * * *